US007174721B2

(12) United States Patent
Mitchell

(10) Patent No.: US 7,174,721 B2
(45) Date of Patent: Feb. 13, 2007

(54) COOLING LOAD ENCLOSED IN PULSE TUBE COOLER

(76) Inventor: Matthew P. Mitchell, 151 Alvarado Rd., Berkeley, CA (US) 94705-1510

( * ) Notice: Subject to any disclaimer, the term of this patent is extended or adjusted under 35 U.S.C. 154(b) by 455 days.

(21) Appl. No.: 10/810,380

(22) Filed: Mar. 26, 2004

(65) Prior Publication Data

US 2005/0210888 A1 Sep. 29, 2005

(51) Int. Cl.
*F25B 9/00* (2006.01)
*F25D 23/12* (2006.01)

(52) U.S. Cl. ..... 62/6; 62/259.2

(58) Field of Classification Search ..... 62/6, 62/259.2

See application file for complete search history.

(56) References Cited

U.S. PATENT DOCUMENTS

| | | | | |
|---|---|---|---|---|
| 3,237,421 | A | 3/1966 | Gifford | |
| 4,722,201 | A | 2/1988 | Hofler et al. | |
| 5,165,243 | A * | 11/1992 | Bennett | 62/6 |
| 5,689,959 | A | 11/1997 | Yatsuzuka et al. | |
| 5,791,149 | A | 8/1998 | Dean | |
| 5,953,920 | A | 9/1999 | Swift et al. | |
| 6,070,414 | A | 6/2000 | Ross et al. | |
| 6,082,117 | A * | 7/2000 | Funatsu et al. | 62/6 |
| 6,112,527 | A * | 9/2000 | Steinmeyer et al. | 62/6 |
| 6,298,670 | B1 * | 10/2001 | Pundak | 62/6 |
| 6,332,323 | B1 * | 12/2001 | Reid et al. | 62/6 |
| 6,376,943 | B1 | 4/2002 | Gamble et al. | |
| 6,532,748 | B1 | 3/2003 | Yuan et al. | |
| 6,595,007 | B2 | 7/2003 | Amano | |
| 6,625,992 | B2 | 9/2003 | Maguire et al. | |
| 6,637,211 | B1 | 10/2003 | Swift et al. | |
| 6,644,038 | B1 | 11/2003 | Acharya et al. | |
| 7,047,749 | B2 * | 5/2006 | Kunitani et al. | 62/6 |
| 7,064,953 | B2 * | 6/2006 | Miller | 361/690 |
| 2003/0154735 | A1 * | 8/2003 | Wurth | 62/259.2 |
| 2003/0163996 | A1 * | 9/2003 | Ravex | 62/6 |
| 2004/0155113 | A1 * | 8/2004 | Urano et al. | |
| 2005/0160744 | A1 * | 7/2005 | Frank et al. | 62/6 |

OTHER PUBLICATIONS

Exair Corporation, Catalogue 17, (2000) p. 74.

Ackermann, R. A. et al., "Cryogenic Refrigerator Evaluation for Medical and Rotating Machine Applications," Cryocoolers 12 (Jun. 18, 2002) pp. 805-811, esp. Figs. 5-6.

Ceridon, K. M., et al., "Remote Cooling with a G-M Cryocooler by Use of COld Electromagnetic Valves Driving an External Flow Loop," Cryocoolers 11, (Jun. 20, 2000), pp. 393-400.

Fleck, U., et al., "Cooling HTS Applications in the Temperature Range of 66 K to 80 K," Advances in Cryogenic Engineering 47A (Jul. 16, 2001) pp. 188-195, esp. Fig. 1.

(Continued)

*Primary Examiner*—William C. Doerrier

(57) ABSTRACT

A cooling load 90 is enclosed within the envelope of the pressure vessel that contains the working fluid in a pulse tube cooler in a load space 95 adjacent to a regenerator 58 of that pulse tube cooler. Flow-smoothing means 63, which include stacked screens and perforated plates, or diffuser nozzle 104 or diffuser cone 106, spreads the flow of fluid that enters the cold end of pulse tube 66.

14 Claims, 4 Drawing Sheets

OTHER PUBLICATIONS

Perin, A., "Study of Materials and Adhesives for Superconducting Cable Feedthroughs," Advances in Cryogenic Engineering 47A (Jul. 16, 2001), pp. 855-862, esp. Fig. 7.
Chen, G. B., "Investigation of a Near-63k Isothermal in a Pulse Tube Refrigerator with He-N2 Mixtures," Advances in Cryogenic Eng'g 47A(Jul. 16, 2001), pp. 855-862, esp. Fig. 7.
Kasthurirengan, S., et al., "Reduction of Convection Heat Losses in Low Frequency Pulse Tube Coolers with Mesh Inserts," Advances in Cryo. Eng'g 45A, (Jul. 12, 1999) pp. 135-142.
Iyengar, K. S., "Effect of Heat Transfer on Cooling of Current Leads," Advances in Cryogenic Engineering 43B (Jul. 28, 1997), pp. 1351-1357, esp. Fig. 1.

* cited by examiner

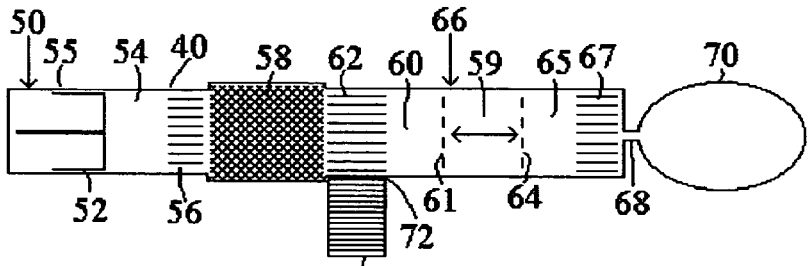
FIG. 1 - PRIOR ART
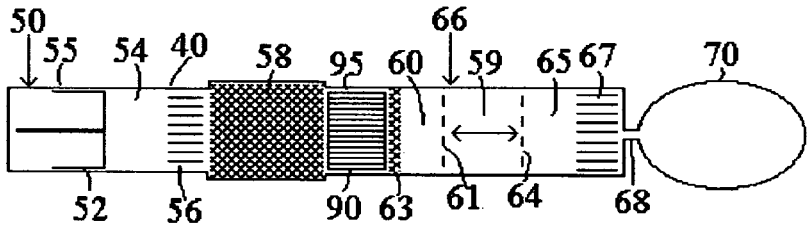
FIG. 2
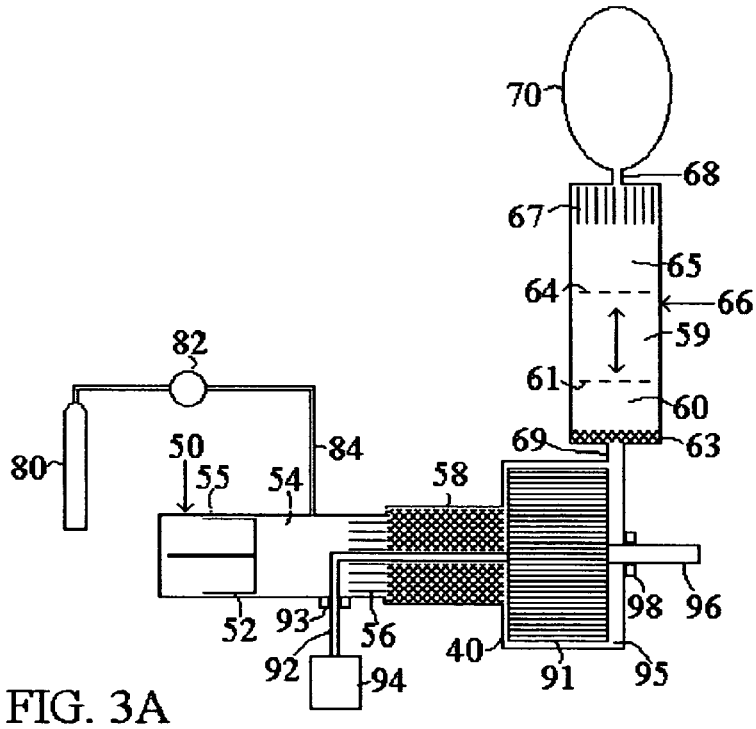
FIG. 3A

COOLING LOAD ENCLOSED IN PULSE TUBE COOLER

CROSS-REFERENCE TO RELATED APPLICATIONS

Not applicable.

GOVERNMENT RIGHTS

Not applicable.

BACKGROUND

1. Field of Invention

The present invention relates generally to devices cooled by pulse tube coolers.

2. Description of Prior Art

Use of superconducting materials in electrical devices, including motors, generators, transformers, electromagnets, power transmission lines and a variety of electronic devices, has greatly improved their performance. However, all presently-known superconducting materials must be cooled to temperatures far below room temperature before they exhibit superconducting properties. For high temperature superconductors, cooling to about 50 Kelvin is desirable; for low temperature superconductors, cooling to less than 10 Kelvin is essential. Other electric, electronic, and electro-optical equipment performs better when cooled even though it is not fabricated using superconducting materials.

Various types of cryocoolers can provide cooling to temperatures required by superconducting devices. Those cryocoolers include Stirling, Gifford-McMahon, Vuilleumier, and pulse tube coolers. However, transfer of heat from superconducting devices to the heat-absorbing heat exchangers of available cryocoolers has proved to be a difficult and demanding task. Integration of cooling devices with rotating equipment has proved to be particularly challenging.

Several approaches to integration of cooling devices and rotating superconducting devices have been proposed. For example, U.S. Pat. No. 6,625,992 issued to Maguire, et al., teaches a bank of cryocoolers cooling a superconducting electric motor through a secondary pumped loop of helium cooled by those cryocoolers. U.S. Pat. No. 6,376,943 issued to Gamble, et al., teaches a closed circulation system, external to a cryocooler, for cooling a rotating superconducting device. U.S. Pat. No. 6,164,077 issued to Feger, recognizes the problem of transmitting heat from a cooling load to the external surface of the cold tip of a cryocooler even when the load is not rotating. U.S. Pat. No. 6,070,414 issued to Ross, et al., teaches a spring-loaded arrangement for interfacing the external surface of the cold tip of a cryocooler with its cooling load.

All of the previous approaches have depended upon drawing heat from the cooling load through the wall of the cooler and thence into the working fluid of the cooler. In all instances, the cooling load has been external to the envelope of the pressure vessel that contains the working fluid of the cooler.

BRIEF SUMMARY OF THE INVENTION

The present invention is directed to combinations of pulse tube coolers and cooling loads including electric, electronic, and electro-optic devices and the like. Those cooling loads are housed and enclosed within the pressure containment vessel of the pulse tube cooler. Those cooling loads are placed at the cold end of the pulse tube of the cooler between the regenerator and the pulse tube and are cooled directly by the working fluid of the cooler, which passes around and through them while the cooler is operating. In effect, the cold heat exchanger of the conventional pulse tube cooler is replaced by the cooling load that would otherwise be cooled indirectly through that heat exchanger. Flow-distributing means located between the cooling load and the pulse tube smooth the flow of fluid entering the pulse tube at its cold end.

OBJECTS AND ADVANTAGES

Several objects and advantages of this invention are:

(1) To simplify the mechanical arrangements required to transfer heat from a device to be cooled to the working fluid of a pulse tube cooler.

(2) To reduce thermodynamic losses resulting from conduction and radiation from a device located externally to the cooler that cools it.

(3) To produce a more compact integration of cooled devices and the pulse tube coolers that cool them.

BRIEF DESCRIPTION OF DRAWING FIGURES

FIG. 1 is a schematic view of a prior art linear orifice pulse tube cooler with external cooling load.

FIG. 2 is a schematic view of a linear orifice tube pulse tube cooler of this invention with internal cooling load.

FIG. 3A is a schematic view of a preferred embodiment of a superconducting electric motor contained within the envelope of the pressure vessel of a pulse tube cooler.

REFERENCE NUMERALS IN DRAWINGS

Figure 3B:
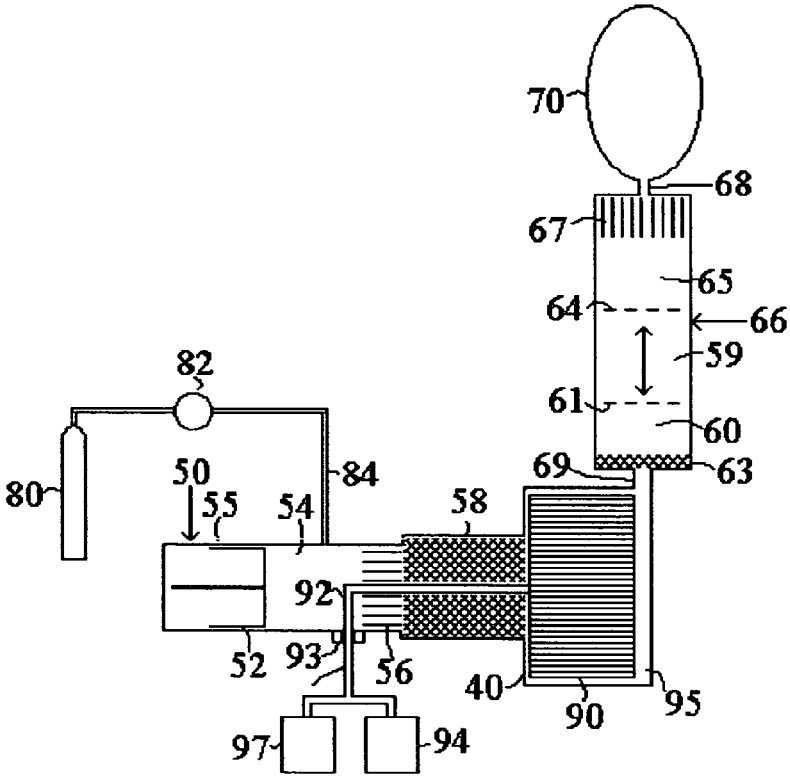
FIG. 3B is a schematic view of a preferred embodiment of a superconducting electric power transformer, electromagnet or electronic device contained within the envelope of the pressure vessel of a pulse tube cooler.

40 envelope of pressure vessel
50 compressor
52 piston
54 compression space
55 cylinder
56 aftercooler
58 regenerator
59 stratified plug of fluid
60 cold fluid
61 cold boundary
62 cold heat exchanger
63 flow distributer
64 warm boundary
65 warm fluid

66 pulse tube
67 warm heat exchanger
68 orifice
69 duct
70 reservoir
72 heat transfer means
80 compressed gas tank
82 pressure regulator
84 gas pipe
86 window
88 sensing surface
90 cooling load
91 electric motor
92 electrical cable
93 cable pass-through
94 application input
95 load space
96 shaft
97 application output
98 gas seal
100 superconducting cable
102 insulated housing
104 diffuser nozzle
106 diffuser cone
158 adjacent regenerator
163 adjacent flow distributer

DETAILED DESCRIPTION OF DRAWING FIGURES

FIG. 1 (Prior Art)

FIG. 1 is a schematic representation of a prior art orifice pulse tube cooler in linear configuration. An envelope of pressure vessel 40 defines the enclosed volume of a pulse tube cooler in which a compressed working fluid, typically helium, is contained. The components of the cooler include a compressor 50, shown as a piston-type compressor with cylinder 55, piston 52, compression space 54, aftercooler 56, regenerator 58, cold heat exchanger 62, pulse tube 66, warm heat exchanger 67, orifice 68 and reservoir 70. All of the components of the cooler are in fluid communication with each other. The thermal load cooled by the cooler is a cooling load 90, which lies outside envelope of pressure vessel 40 and is thermally connected to cold heat exchanger 62 by heat transfer means 72 known to the art. Those means include direct contact, heat pipes, and thermally conductive links of braided copper wire or other material. Those means also include secondary loops of pumped cold fluid in the case of cooling loads with rotating elements, such as motors and generators.

PREFERRED EMBODIMENTS

FIGS. 2–3F

FIG. 2 is a schematic representation of a pulse tube cooler and a cooling load 90 combined in accordance with this invention. The components of the pulse tube cooler are as in FIG. 1, except that: (1) cold heat exchanger 62 has been removed; (2) cooling load 90 has been placed in pulse tube 66 adjacent to regenerator 58, and (3) flow distributer 63 has been placed in pulse tube 66 between cooling load 90 and cold boundary 61. Flow distributer 63 may be in any convenient form; depending upon the size of pulse tube 66, a short stack of about 10 or 20 relatively coarse screens, in approximately the range of 80 to 100 mesh, may be adequate. Flow distributers in the form of perforated plates, as shown, for example, in U.S. Pat. No. 6,082,117 issued to Funatsu, et al., are equivalent. Other flow straightening devices are shown in FIGS. 3E and 3F, discussed below. Pulse tube 66 is in fluid communication with regenerator 58 through flow passages around and, possibly, through, cooling load 90.

FIG. 3A is a schematic representation of a preferred embodiment of the combination of this invention wherein the cooling load is an electric motor 91. Pulse tube 66 is in fluid communication with regenerator 58 through duct 69, passages in flow distributer 63, and passages around and through electric motor 91 which is located in load space 95. Electric power to electric motor 91 is supplied from application input 94, which, in the case of a motor is a source of electric power, through electrical cable 92, which penetrates envelope of pressure vessel 40 at a convenient location through cable pass-through 93. As shown, electrical cable 92 passes through the center of regenerator 58, which may conveniently be a foil regenerator arranged as described, for example, in U.S. Pat. Nos. 5,429,177 and 6,347,453. Shaft 96 protrudes through envelope of pressure vessel 40 through gas seal 98. Compressed gas tank 80 is in fluid communication with components inside envelope of pressure vessel 40 through pressure regulator 82 and gas pipe 84.

The cooling load referred to in FIG. 3A is electric motor 91. This invention applies to an electric motor equipped with superconducting materials and to any other type of motor that requires cooling. Where only the rotor of electric motor 91 requires cooling, the stator of that motor may remain outside envelope of pressure vessel 40, with the rotor occupying load space 95 inside envelope of pressure vessel 40.

Although the cooling load referred to in FIG. 3A is an electric motor 91, this invention applies equally to other types of rotating equipment that require cooling, including but not limited to electric generators and rectifiers, whether constructed with superconducting materials or not. Whereas electrical cable 92 delivers power to motor 91 in FIG. 3A, electrical cable 92 would carry power from a generator substituted for motor 91.

FIG. 3B is a schematic representation of an alternate preferred embodiment of the combination of this invention where cooling load 90 is electrical or electronic and its output is electric current and/or voltage. Examples of cooling load 90 include power transformers, electromagnets, rectifiers and capacitors as well as electronic signal- and data-processing devices. Application input 94 and application output 97 are connected to cooling load 90 through electrical cable 92, which passes through envelope of pressure vessel 40 through cable pass-through 93.

Figure 3C:
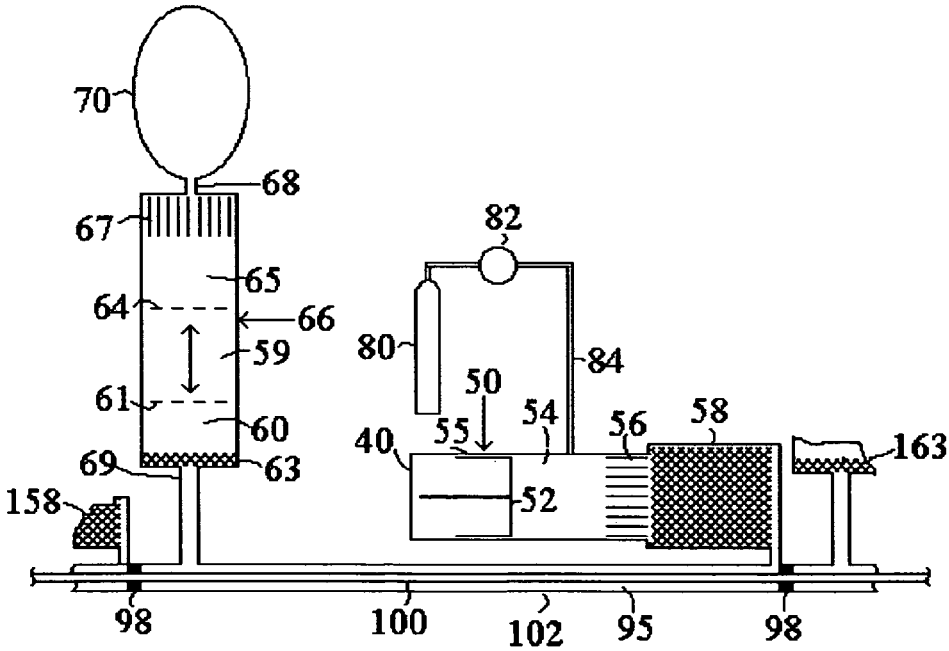
FIG. 3C is a schematic view of a preferred embodiment of a superconducting cable located in an insulated housing and contained within the envelope of the pressure vessel of a pulse tube cooler.

FIG. 3C is a schematic representation of an alternate preferred embodiment of the combination of this invention where the cooling load is a superconducting cable 100, which is contained in an insulated housing 102 that comprises load space 95. An annular passage between cable 100 and insulated housing 102 allows working fluid of the cooler to pass between regenerator 58 and flow distributer 63.

Figure 3D:
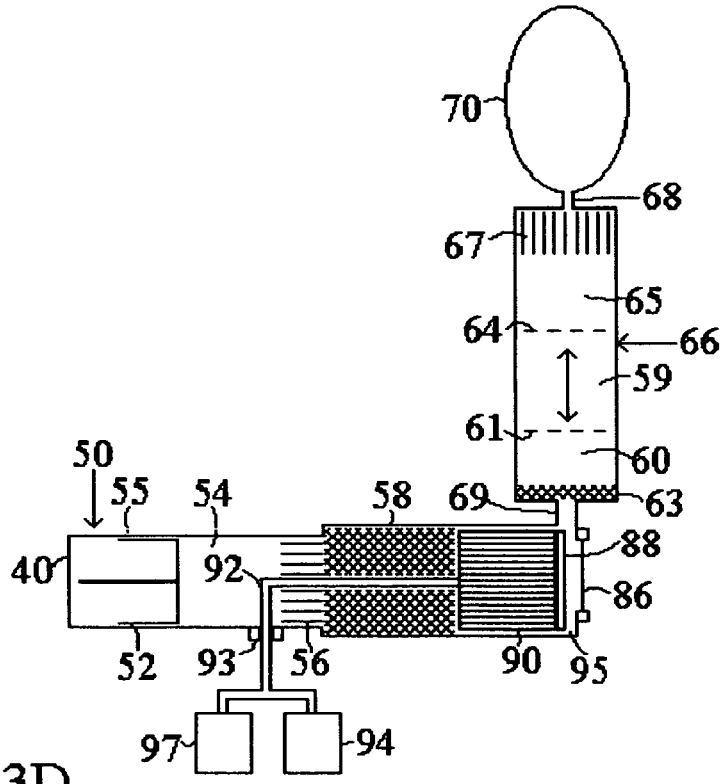
FIG. 3D is a schematic view of a preferred embodiment of an electro-optic device contained within the envelope of the pressure vessel of a pulse tube cooler.
Figure 3E:
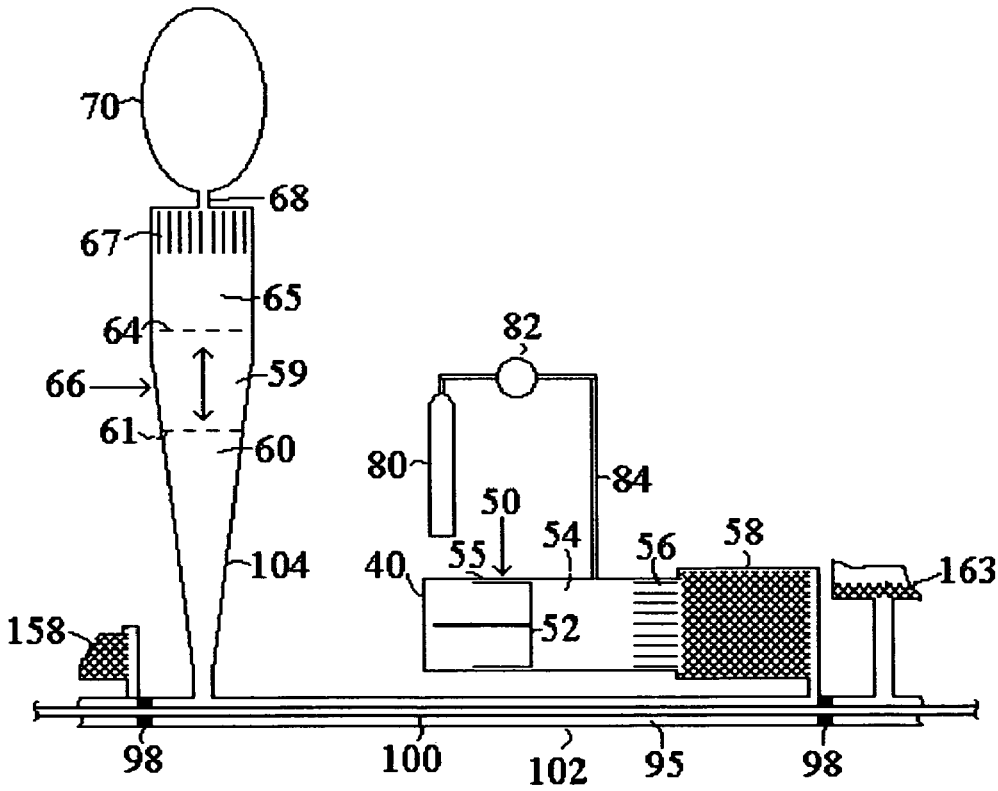
FIG. 3E is a schematic view illustrating an alternate preferred embodiment to the embodiment of FIG. 3C, incorporating a flow distributer in the form of a diffuser nozzle.
Figure 3F:
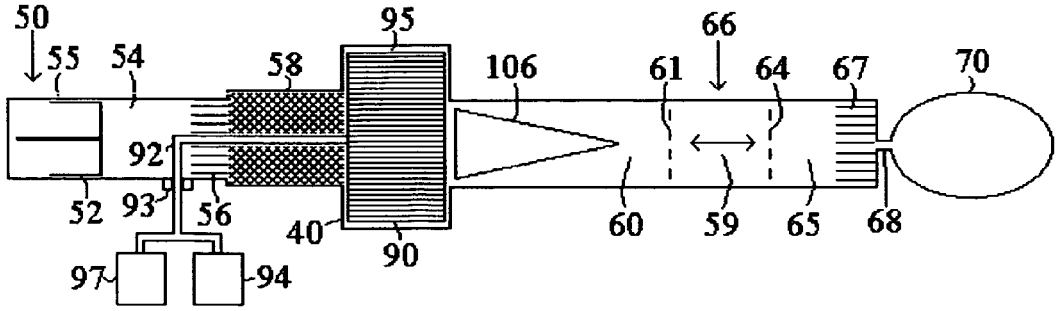
FIG. 3F is a schematic view illustrating an alternate preferred embodiment to the embodiment of FIG. 3B incorporating a flow distributer in the form of a diffuser cone.

FIG. 3D is a schematic representation of an alternate preferred embodiment of the combination of this invention where cooling load 90 is an electro-optic device such as an infrared sensor. The radiation to be detected passes through a window 86 and is detected on a sensing surface 88, which may be a focal plane array.

FIG. 3E is a schematic representation of an alternate preferred embodiment of the combination shown in FIG. 3C. Flow into pulse tube 66 is distributed by a diffuser nozzle 104 rather than by flow distributer 63 as in FIG. 3C. Diffuser nozzle 104 as in FIG. 3E could also be used in place of flow distributer 63 in connection with the arrangements shown in FIGS. 3A, 3B and 3D.

FIG. 3F is a schematic representation of an alternate preferred embodiment of the combination shown in FIG. 3B where flow into pulse tube 66 is distributed by a diffuser cone 106 rather than by flow distributer 63 as in FIG. 3B or diffuser nozzle 104 as in FIG. 3E. Diffuser cone 106 as in FIG. 3F could also be used in place of flow distributer 63 in connection with the arrangements shown in FIGS. 3A, 3C and 3D.

OPERATION OF PRIOR ART AND OF THIS INVENTION

Pulse Tube Coolers (Prior Art)

The prior art orifice pulse tube cooler illustrated in FIG. 1 operates with the well-known pulse tube cycle. Piston 52 moves back and forth in cylinder 55 to alternately increase and decrease the volume of compression space 54. The motion of piston 52 alternately forces fluid through aftercooler 56 into regenerator 58, cold heat exchanger 62, pulse tube 66, warm heat exchanger 67, and orifice 68 into reservoir 70 and permits fluid to return by the same path to compression space 54. Cyclically compressing and expanding the fluid causes the pressure in the fluid to vary cyclically. Orifice 68 serves to modify the phase of flow in pulse tube 66 relative to pressure so that fluid in pulse tube 66 moves from pulse tube 66 through warm heat exchanger 67 into reservoir 70 while average pressure in pulse tube 66 is higher than it is while fluid moves from pulse tube 66 into cold heat exchanger 62. The overall effect is to transfer heat from cooling load 90 through heat transfer means 72 to cold heat exchanger 62 and through cold heat exchanger 62 to the working fluid that is confined inside the envelope of pressure vessel 40.

FIG. 1 shows a piston-type compressor, but various other devices known to the art can be used to create the cyclical movement of fluid back and forth through regenerator 58 and corresponding change in fluid pressure in pulse tube 66. One such widely-used arrangement (not shown) employs a rotary valve that connects regenerator 58 alternately to a reservoir of fluid at higher pressure than pressure in the cooler and to a reservoir of fluid at lower pressure than pressure in the cooler. Another arrangement (not shown) employs a thermal compressor with a heat source and mechanical displacer such as is employed in Vuilleumier refrigerators. Still another arrangement is a thermal acoustic device that generates a cyclic pressure wave without moving parts, as described in, for example, in U.S. Pat. No. 6,032,464 issued to Swift, et al. For purposes of the pulse tube cycle, the source of the pressure wave is immaterial. What is essential is that fluid be driven cyclically back and forth through the regenerator by some appropriate compressor means.

FIG. 1 shows a linear arrangement of components between compressor 50 and reservoir 70. However, other arrangements of pulse tube coolers are well known to the art, including "U tube" arrangements (not shown) in which a pulse tube and regenerator are parallel to each other and are connected to each other at their cold end through a cold heat exchanger. Another alternate arrangement is a coaxial arrangement (not shown) in which an annular regenerator surrounds a pulse tube and a cold heat exchanger connects the regenerator and pulse tube at their cold ends.

FIG. 1 shows an orifice 68 and a reservoir 70 as the phase-shifting device at the warm end of the pulse tube, but other devices known to the art can be used to create the phase shift that results in heat transfer from cold heat exchanger 62 to warm heat exchanger 67. One such phase-shifting arrangement is an inertance tube (not shown) between warm heat exchanger 67 and reservoir 70 as shown, for example, in my prior U.S. Pat. No. 5,966,943. Another such phase-shifting arrangement is a double inlet bypass (not shown) connected between warm heat exchanger 67 and compression space 54 as shown, for example, in U.S. Pat. No. 5,335,505 issued to Ohtani, et al. Another such phase-shifting arrangement is a valved connection (not shown) between warm heat exchanger 67 and high pressure and low pressure reservoirs (the so-called "4 valve" method). Still another such phase-shifting arrangement (not shown) replaces reservoir 70 with a variable volume controlled by a piston at the warm end of the pulse tube. For purposes of the pulse tube cycle, the method of phase shifting is immaterial. What is essential to effective performance of the cooler is that the correct shift between fluid flow and fluid pressure in the pulse tube be obtained.

In a conventional pulse tube cooler such as that shown in FIG. 1, pulse tube 66 is typically a smooth-walled cylindrical tube. Cold heat exchanger 62 and warm heat exchanger 67 are designed to cause fluid entering pulse tube 66 to flow smoothly, and at the same rate, all across the cross section of pulse tube 66. To the extent possible, the front of the fluid advancing into the pulse tube from both of those heat exchangers is straight across the cross section of pulse tube 66. Fluid first entering pulse tube 66 from each of those heat exchangers reaches a boundary at which it stops advancing into pulse tube 66 and begins to retreat. Cold boundary 61, at which fluid first entering pulse tube 66 from cold heat exchanger 62 stops advancing into pulse tube 66 and begins to retreat, is short of the middle of pulse tube 66. Warm boundary 64, at which fluid first entering pulse tube 66 from warm heat exchanger 67 stops advancing into pulse tube 66 and begins to retreat, is short of the middle of pulse tube 66. Between cold boundary 61 and warm boundary 64 lies stratified plug of fluid 59 that moves back and forth in pulse tube 66 but never enters either cold heat exchanger 62 or warm heat exchanger 67. The temperature of stratified plug of fluid 59 varies from cold boundary 61 to warm boundary 64. Ideally, the temperature of fluid in stratified plug of fluid 59 is evenly graduated from one end to the other, and thus the same across any cross section. If warranted, special efforts can be made to reduce the disruptive effect of heat transfer back and forth between fluid and pulse tube 66 by tapering that tube slightly as taught by Olson's and Swift's U.S. Pat. No. 5,953,920 or by lining pulse tube 66 with a liner of low thermal mass as taught by my prior U.S. Pat. No. 6,619,046.

While a smooth, perfectly stratified temperature gradient over the length of pulse tube 66 is important, there is no such requirement for internal flow within either cold heat exchanger 62 or warm heat exchanger 67. It is only important that the flow emerge from those heat exchangers into pulse 66 in a smooth, even front. What has not been previously recognized is that the acceptability of chaotic flow in spaces outside the pulse tube itself creates the opportunity to enclose the cooling load inside the envelope of the cooler's pressure vessel.

OPERATION

FIGS. 2–3F

FIG. 2 illustrates the basic concept of this invention. Operation of the cooler is generally the same as in the prior art cooler illustrated in FIG. 1, except that instead of transferring heat from the cooling load 90 into a cold heat exchanger 62 through the envelope of pressure vessel 40 by way of heat transfer means 72 as in the prior art shown in FIG. 1, cooling load 90 is placed inside the envelope of pressure vessel 40, where it is bathed with cold working fluid. In the invention illustrated in FIG. 2, cold heat exchanger 62 of FIG. 1 is eliminated and heat is removed directly from cooling load 90 by cold fluid that flows in and around it as that fluid passes cyclically back and forth through load space 95 between regenerator 58 and pulse tube 66. To ensure that flow into pulse tube 66 enters properly, flow straightening device 63 is interposed at the cold end of pulse tube 66 between load space 95 and pulse tube 66.

The size and shape of load space 95 is not as important as the proportion of that space that is occupied by cooling load 90. Flow passages around cooling load 90 and, as appropriate, through, cooling load 90 must be sufficiently large to permit fluid flows back and forth between regenerator 58 and pulse tube 66 without undue loss resulting from pressure drop. However, for effective heat transfer, flow passages should be narrow enough to facilitate good heat transfer between cooling load 90 and the fluid in which it is bathed. Otherwise, there is no special constraint on the shape of load space 95. That space need not be cylindrical, or any other particular shape, and dead volumes in that space can be reduced by the use of plugs and fillers as appropriate in ways known to the art. Fluid flows through load space 95 may be adjusted using plugs and baffles in ways known to the art.

Because load space 95 can be any convenient shape, it can be elongated to accommodate a length of superconducting power transmission cable or foreshortened and widened to accommodate a motor, generator, circuit board containing electronic components, or other types of cooling load.

Dead volume in load space 95 is defined as space not occupied by cooling load 90 or by plugs or baffles. Magnitude of the dead volume in load space 95 is the primary determinant of the overall size of pulse tube 66. Cold boundary 61 should not move past flow distributer 63 at any time in the cycle. However, some fluid entering load space 95 from regenerator 58 should, over the course of the cycle, move completely through load space 95. Thus, in order to allow required movement of fluid through load space 95, pulse tube 66 must be large enough to allow commensurate volume of cold fluid 60 to move back and forth in pulse tube 66 without violating constraints on movement of cold boundary 61. Total dead volume in load space 95 should bear approximately the same relation to volume in pulse tube 66 as dead volume in cold heat exchanger 62 in the conventional pulse tube shown in FIG. 1 bears to volume in the pulse tube of a well designed cooler of the type shown in FIG. 1. If the cooling load 90 fills most of load space 95 leaving a relatively small dead volume there, the overall dimensions of load space 95 can be large relative to the dimensions of the other components of the pulse tube cooler.

FIG. 3A schematically illustrates a pulse tube cooler and load arrangement that is topologically identical to the arrangement shown schematically in FIG. 2. Although pulse tube 66 and related components shown in FIG. 3A are not aligned on the same axis as in FIG. 2, the operative components are still arranged in the same series relative to each other.

FIG. 3A illustrates an electric motor 91 enclosed within the envelope of pressure vessel 40. Shaft 96 of electric motor 91 pierces envelope of pressure vessel 40 through gas seal 98, enabling shaft 96 to deliver rotating power to an external mechanical load. Because gas seal 98 may not be perfectly effective in preventing some leakage of fluid, compressed gas tank 80 is connected to envelope of pressure vessel 40 at a convenient location through gas pipe 84. Pressure regulator 82 in gas pipe 84 controls the pressure at which make-up fluid is delivered through envelope of pressure vessel 40 to replenish fluid lost by leakage. Power is delivered by electrical cable 92 which pierces envelope of pressure vessel 40 through cable pass-through 93, which permits electric power to flow but prevents leakage of working fluid. The arrangement shown in FIG. 3A is equally applicable to a generator that could be substituted for electric motor 91, except that mechanical power would be delivered to the generator through shaft 96 and electric power would flow out rather than in through electrical cable 92 and cable pass-through 93.

FIG. 3B illustrates the same topological arrangement of the cooler as FIGS. 2 and 3A except that both the input and output of cooling load 90 are electrical. Application input 94 provides power and signal input. Input and output power and signals are transmitted to and from the cooling load through electrical cable 92 and cable pass-through 93. Application output 97 receives power or signal or both from cooling load 90. Any device that can benefit from being cooled, and that can reasonably be fitted into load space 95, can be cooled. Those devices include, by way of example and not limitation, transformers, electromagnets, power converters and inverters, integrated circuits, IGBTs, transistors, diodes, capacitors, radio frequency filters and the like.

FIG. 3C illustrates an application of this invention to a superconducting cable 100. Load space 95 is an elongated insulated housing 102 and the flow path between regenerator 58 and flow distributer 63 is in an annulus between superconducting cable 100 and insulated housing 102. To cool an extended length of cable, additional pulse tube coolers can be employed; FIG. 3C shows adjacent regenerator 158 of a pulse tube cooler to the left, and adjacent flow distributer 163 of a pulse tube cooler to the right, of the pulse tube cooler shown in full in FIG. 3C.

FIG. 3D illustrates the same topological arrangement and mode of operation as FIG. 3B except that the electronic device comprising cooling load 90 is an electro-optical device such as an infrared focal plane array. Radiation sensed by the optical device enters space occupied by cooling load 95 through window 86. Window 86 is fabricated from material that is transparent to the wavelength of radiation that is detected on sensing surface 88. Window 86 comprises a portion of envelope of pressure vessel 40.

FIG. 3E shows an alternate preferred embodiment of a pulse tube cooler of this invention that is topologically similar the embodiments illustrated in FIGS. 2, 3A, 3B, 3C and 3D except for flow distributer 63 in those figures. In place of flow distributer 63, a diffuser nozzle 104 shown in FIG. 3D performs the same function. Use of diffuser nozzle 104 can be beneficial where flow emerging from load space 95 into pulse tube 66 has been constrained in a passage with a relatively narrow cross section as in FIG. 3C, or where it is convenient to gather the flow from load space 95 into a conduit with a relatively small cross section such as duct 69 as in FIGS. 3A, 3B, 3C and 3D. Diffuser nozzle 104 avoids regenerative losses that result from heat transfer back and forth between working fluid and a stacked screen or perforated plate flow distributer 63 of FIGS. 2, 3A, 3B, 3C and 3D. The included angle in diffuser nozzle 104 should not exceed about 11 degrees, which means that pulse tube 66 will usually be longer than it would be with flow distributer 63 for the same volume in pulse tube 66.

FIG. 3F provides an alternate method of distributing flow entering the cold end of pulse tube 66. A diffuser cone 106 gradually spreads and slows the flow of fluid entering pulse tube 66 at the cold end. That method of flow smoothing is particularly appropriate where the cross section of fluid entering pulse tube 66 is large.

ADVANTAGES

This invention improves upon prior art arrangements in that the cooled device is cooled directly by the working fluid in the pulse tube rather than by transfer of heat through the envelope of the pressure vessel of the cryocooler. This invention eliminates the cold heat exchanger and the hardware that conducts heat from the cooling load to the cold heat exchanger. It eliminates the thermodynamic losses associated with indirect heat transfer. It eliminates the need for separate insulation for the pulse tube and for the load cooled by the pulse tube. When applied to cooling loads containing rotating components, this invention eliminates the need for a secondary loop of fluid that is cooled by the cold heat exchanger of the cooler and it eliminates the need for fans or pumps that circulate fluid through the secondary loop. All of these advantages reduce thermodynamic losses and save energy.

CONCLUSIONS, RAMIFICATIONS AND SCOPE

Any electrical, electronic or electro-optic device that requires cooling and that can be fitted into the cold part of a pulse tube cooler can benefit from this invention. Because the shape of the space into which the cooled device is fitted is variable over a wide range, many different types of devices can be cooled. This invention can employ pulse tube coolers with a wide variety of compressors, phase shifting devices, and pulse tube/regenerator configurations. This invention has special value for applications that involve rotating machinery because the working fluid confined in the cooler can readily permeate all parts of that machinery and remove heat from them while the rotating parts rotate.

Although the description above contains many specifics, these should not be construed as limiting the scope of the invention but merely as providing illustrations of some of the presently preferred embodiments of this invention. Thus, the scope of this invention should be determined by the appended claims and their legal equivalents, rather than by the examples given.

I claim:

1. A pulse tube cooler in combination with a cooling load wherein said cooling load is enclosed by the pressure vessel of said pulse tube cooler, and wherein said cooling load is in direct contact with the working fluid of said pulse tube cooler, and wherein flow distributer means are interposed between said cooling load and the pulse tube of said pulse tube cooler.

2. The combination of claim 1 wherein said cooling load is an electrical device.

3. The combination of claim 2 wherein said electrical device is selected from the group consisting of motors and generators.

4. The combination of claim 2 wherein said electrical device comprises a rotating element of a device selected from the group consisting of motors and generators.

5. The combination of claim 2 wherein said electrical device is selected from the group consisting of electromagnets and transformers.

6. The combination of claim 2 wherein said electrical device comprises components selected from the group consisting of transistors, diodes, capacitors, rectifiers and integrated circuits.

7. The combination of claim 2 wherein said electric device comprises an electro- optical device.

8. The combination of claim 7 wherein said electro-optical device senses radiation in the infrared spectrum.

9. The combination of claim 7 wherein said electro-optical device comprises a focal plane array.

10. A pulse tube cooler in combination with a cooling load wherein said cooling load is contained within the envelope of the pressure vessel of said pulse tube cooler, and wherein flow distributer means are interposed between said cooling load and the pulse tube of said pulse tube cooler and wherein said cooling load comprises an electro-optical device, and wherein said envelope of said pressure vessel of said pulse tube cooler contains a transparent window.

11. The combination of claim 1 wherein said cooling load comprises superconducting material.

12. The combination of claim 1 wherein said cooling load comprises superconducting wire.

13. The combination of claim 1 wherein said flow distributer means are selected from the group consisting of stacked screens and perforated plates.

14. The combination of claim 1 wherein said flow distributer means are selected from the group consisting of diffuser nozzles and diffuser cones.

* * * * *